US008257045B2

(12) United States Patent
Spangler et al.

(10) Patent No.: US 8,257,045 B2
(45) Date of Patent: Sep. 4, 2012

(54) PLATFORMS WITH CURVED SIDE EDGES AND GAS TURBINE ENGINE SYSTEMS INVOLVING SUCH PLATFORMS

(75) Inventors: Brandon W. Spangler, Vernon, CT (US); Jeffrey S. Beattie, West Hartford, CT (US); Scott D. Hjelm, Windsor Locks, CT (US)

(73) Assignee: United Technologies Corp., Hartford, CT (US)

( * ) Notice: Subject to any disclaimer, the term of this patent is extended or adjusted under 35 U.S.C. 154(b) by 1055 days.

(21) Appl. No.: 12/192,271

(22) Filed: Aug. 15, 2008

(65) Prior Publication Data

US 2010/0040460 A1 Feb. 18, 2010

(51) Int. Cl.
*F01D 5/30* (2006.01)
*F01D 11/00* (2006.01)

(52) U.S. Cl. ..... 416/193 A; 416/223 R

(58) Field of Classification Search ..... 415/914; 416/193 A, 223 A, 234, 243
See application file for complete search history.

(56) References Cited

U.S. PATENT DOCUMENTS

| | | | | |
|---|---|---|---|---|
| 4,650,399 | A | 3/1987 | Craig et al. | |
| 4,802,824 | A | 2/1989 | Gastebois et al. | |
| 5,738,489 | A | 4/1998 | Lee | |
| 6,217,283 | B1 * | 4/2001 | Ravenhall et al. | 416/2 |
| 6,371,725 | B1 * | 4/2002 | Manteiga et al. | 415/209.4 |
| 6,478,539 | B1 * | 11/2002 | Trutschel | 415/223 |
| 6,554,571 | B1 | 4/2003 | Lee et al. | |
| 6,726,452 | B2 | 4/2004 | Strassberger et al. | |
| 6,951,447 | B2 | 10/2005 | Cherolis et al. | |
| 6,991,430 | B2 | 1/2006 | Stec et al. | |
| 7,175,386 | B2 * | 2/2007 | Cherolis et al. | 415/115 |
| 7,179,049 | B2 | 2/2007 | Glasspoole | |
| 7,284,958 | B2 | 10/2007 | Dundas et al. | |
| 7,478,994 | B2 * | 1/2009 | Cunha et al. | 416/97 R |
| 7,686,567 | B2 * | 3/2010 | Grover et al. | 415/1 |
| 2005/0135922 | A1 * | 6/2005 | Cherolis et al. | 415/115 |
| 2009/0035128 | A1 * | 2/2009 | Ahmad | 415/177 |
| 2009/0238683 | A1 * | 9/2009 | Alvanos et al. | 415/173.7 |

* cited by examiner

*Primary Examiner* — Sheila V. Clark
(74) *Attorney, Agent, or Firm* — Carlson, Gaskey & Olds, P.C.

(57) ABSTRACT

Platforms with curved side edges and gas turbine engine systems involving such platforms are provided. In this regard, a representative airfoil assembly for a gas turbine engine includes: a platform having a gas path side, a non-gas path side, a leading edge, a trailing edge, a first side edge extending between the leading edge and the trailing edge and exhibiting a first curve along a length thereof, and a second side edge extending between the leading edge and the trailing edge and exhibiting a second curve along a length thereof; and an airfoil extending from the gas path side of the platform; the platform and the airfoil exhibiting a unitary construction such that a continuous exterior surface blends from the airfoil to the platform.

21 Claims, 3 Drawing Sheets

PLATFORMS WITH CURVED SIDE EDGES AND GAS TURBINE ENGINE SYSTEMS INVOLVING SUCH PLATFORMS

STATEMENT REGARDING FEDERALLY SPONSORED RESEARCH AND DEVELOPMENT

The U.S. Government may have an interest in the subject matter of this disclosure as provided for by the terms of contract number F33615-03-D-2345 awarded by the United States Air Force.

BACKGROUND

1. Technical Field

The disclosure generally relates to gas turbine engines.

2. Description of the Related Art

Various gas turbine engine components are subjected to heating and cooling cycles that cause the components to expand and contract. Turbine vanes and blades are examples of such components. Unfortunately, expansion and contraction can result in thermal-mechanical fatigue, which can manifest as cracks in the components.

SUMMARY

Platforms with curved side edges and gas turbine engine systems involving such platforms are provided. In this regard, an exemplary embodiment of an airfoil assembly for a gas turbine engine comprises: a platform having a gas path side, a non-gas path side, a leading edge, a trailing edge, a first side edge extending between the leading edge and the trailing edge and exhibiting a first curve along a length thereof, and a second side edge extending between the leading edge and the trailing edge and exhibiting a second curve along a length thereof; and an airfoil extending from the gas path side of the platform; the platform and the airfoil exhibiting a unitary construction such that a continuous exterior surface blends from the airfoil to the platform.

An exemplary embodiment of an assembly for a gas turbine engine comprises: a first airfoil assembly having a first platform and a first airfoil; and a second airfoil assembly having a second platform and a second airfoil; a first platform having a gas path side, a non-gas path side, a leading edge, a trailing edge, and a first side edge extending between the leading edge and the trailing edge and exhibiting a first curve along a length thereof; the first airfoil extending from the gas path side of the first platform; the first platform and the first airfoil exhibiting a unitary construction such that a continuous exterior surface blends from the first airfoil to the first platform; the second platform having a gas path side, a non-gas path side, a leading edge, a trailing edge, and a second side edge extending between the leading edge and the trailing edge and exhibiting a second curve along a length thereof; the second airfoil extending from the gas path side of the second platform; the second platform and the second airfoil exhibiting a unitary construction such that a continuous exterior surface blends from the second airfoil to the second platform; the first side edge being complementary in shape with respect to the second side edge.

An exemplary embodiment of a gas turbine engine comprises: a compressor; and a turbine operative to drive the compressor; at least one of the compressor and the turbine having a platform and an airfoil, the platform having a gas path side, a non-gas path side, a leading edge, a trailing edge, a first side edge extending between the leading edge and the trailing edge and exhibiting a first curve along a length thereof, and a second side edge extending between the leading edge and the trailing edge and exhibiting a second curve along a length thereof, the airfoil extending from the gas path side of the platform; the platform and the airfoil exhibiting a unitary construction such that a continuous exterior surface blends from the airfoil to the platform.

Other systems, methods, features and/or advantages of this disclosure will be or may become apparent to one with skill in the art upon examination of the following drawings and detailed description. It is intended that all such additional systems, methods, features and/or advantages be included within this description and be within the scope of the present disclosure.

BRIEF DESCRIPTION OF THE DRAWINGS

Many aspects of the disclosure can be better understood with reference to the following drawings. The components in the drawings are not necessarily to scale. Moreover, in the drawings, like reference numerals designate corresponding parts throughout the several views.

DETAILED DESCRIPTION

Platforms with curved side edges and gas turbine engine systems involving such platforms are provided, several exemplary embodiments of which will be described in detail. In this regard, the platforms are used to mount airfoils (e.g., blade or vane airfoils) that extend across gas paths of gas turbine engines. In some embodiments, opposing side edges of the platforms are curved in order to reduce the potential for the platforms to exhibit thermal-mechanical fatigue and/or creep. Notably, creep is the tendency of a material to deform plastically in responsive to stress. By curving the side edges, the mass moment arms of the platforms are reduced, directly contributing in a reduction of creep. Additionally, since the side edges typically are difficult to cool and are usually relatively hot during operation in comparison with other portions of a platform, those embodiments that remove material from a platform to form such a curve also potentially remove the relatively hot portions.

Figure 1:
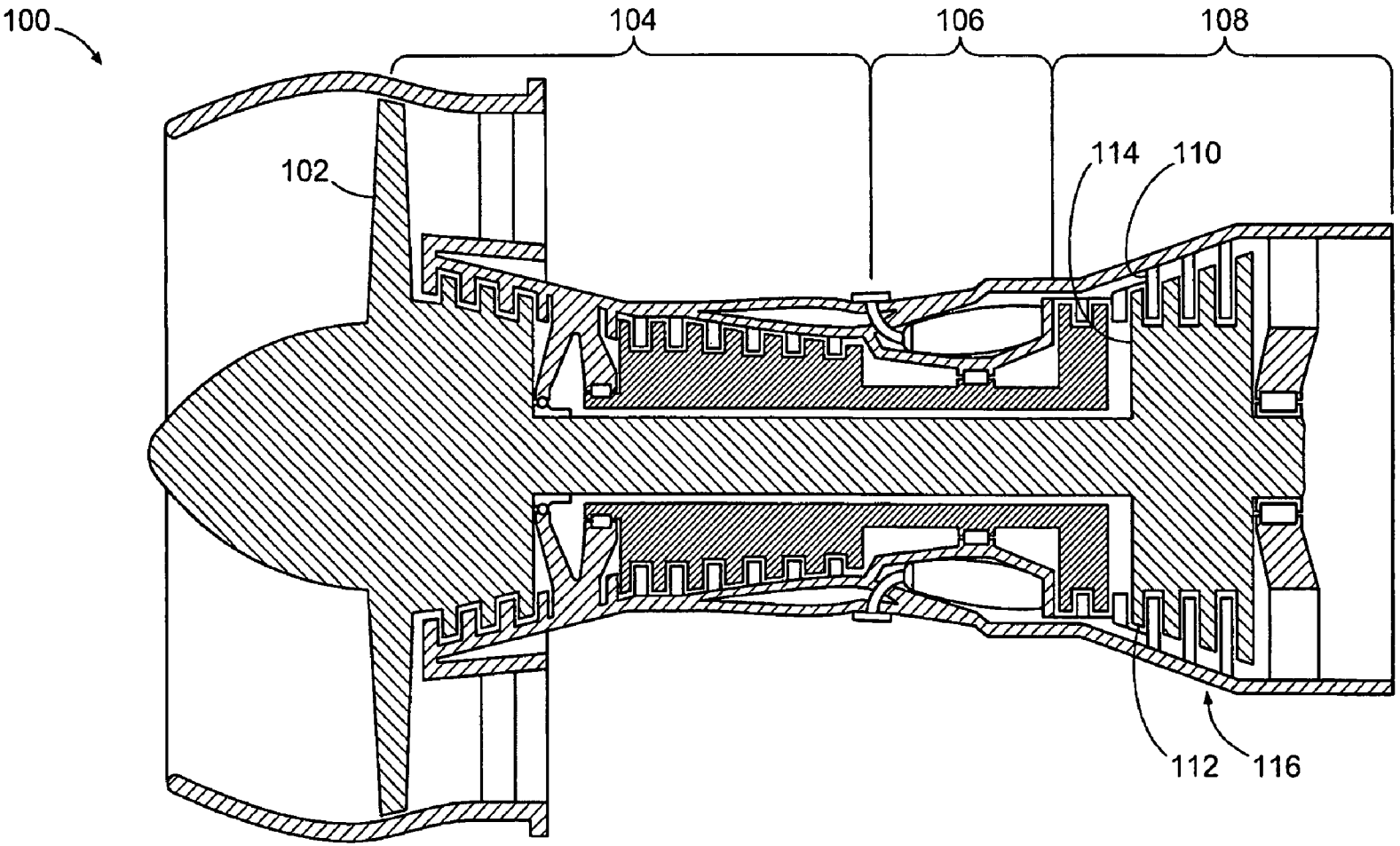
FIG. 1 is a schematic diagram depicting an exemplary embodiment of a gas turbine engine.

In this regard, reference is made to the schematic diagram of FIG. 1, which depicts an exemplary embodiment of a gas turbine engine. As shown in FIG. 1, engine 100 is depicted as a turbofan that incorporates a fan 102, a compressor section 104, a combustion section 106 and a turbine section 108. Turbine section 108 includes alternating sets of stationary vanes (e.g., vane 110) and rotating blades (e.g., blade 112), with the blades being attached to corresponding disks of a turbine. By way of example, blade 112 is attached to turbine disk 114 of low pressure turbine 116. Although depicted as a turbofan gas turbine engine, it should be understood that the concepts described herein are not limited to use with turbofans, as the teachings may be applied to other types of gas turbine engines. Additionally, although the following description focuses on uses with blades of a low pressure turbine, there is no intention to limit the concepts to blades or turbines, as the teachings may be also be applied to vanes and compressors, for example.

Figure 2:
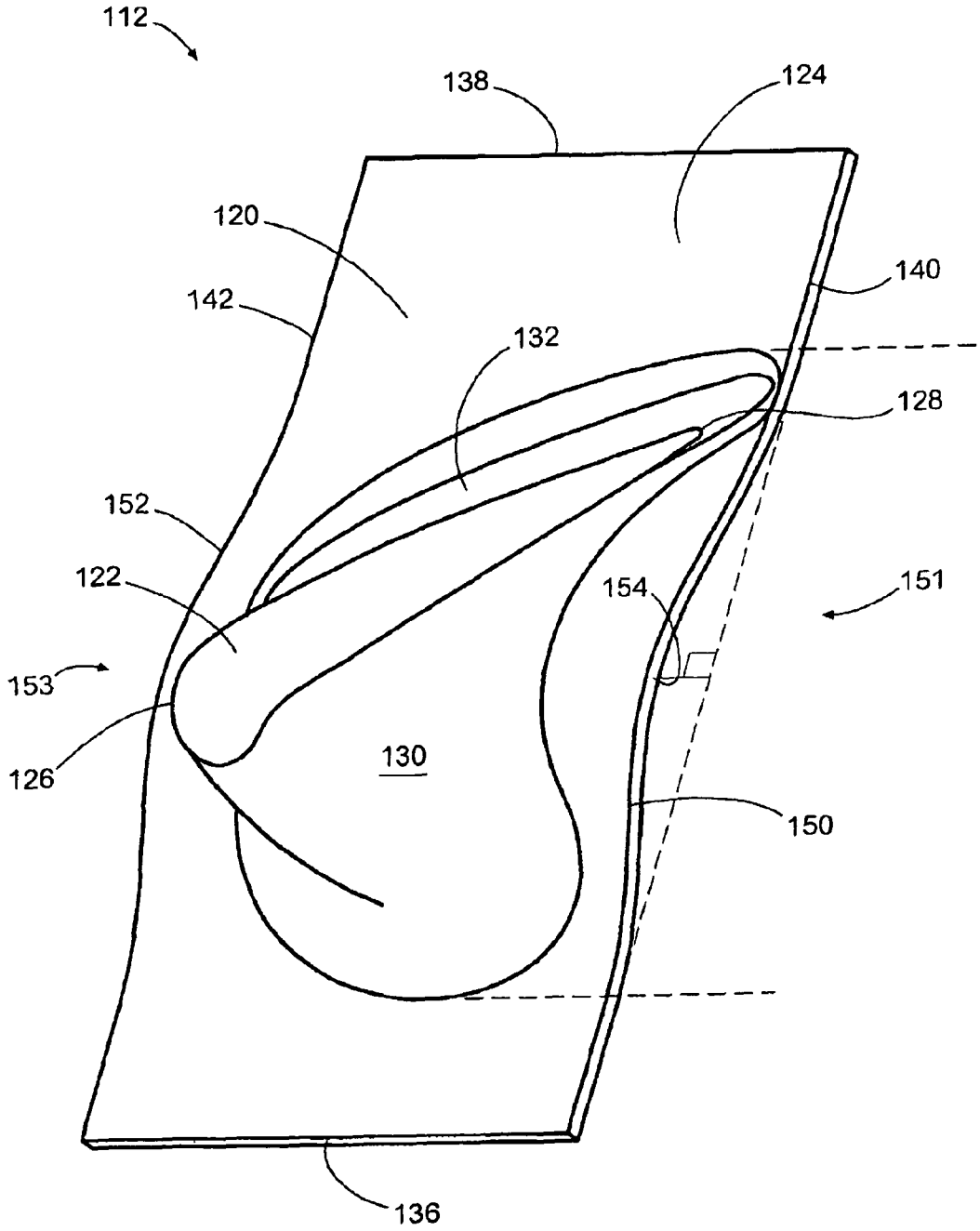
FIG. 2 is a top view of an exemplary embodiment of an airfoil assembly.

FIG. 2 is a top view of an exemplary embodiment of an airfoil assembly. Specifically, FIG. 2 depicts blade 112 of FIG. 1. As shown in FIG. 2, blade 112 incorporates a platform 120 and an airfoil 122 that extends from a gas path side 124 of the platform. Airfoil 122 includes a leading edge 126, a trailing edge 128, a pressure side 130 and a suction side 132. Similarly, platform 120 includes a leading edge 136, a trailing edge 138, a pressure side edge 140 and a suction side edge 142. Notably, platform 120 is an inner diameter platform with the side edges being spaced from the airfoil, at least along portions of the respective lengths of the side edges.

In the embodiment of FIG. 2, side edges 140 and 142 of the platform exhibits curves that extend along portions of the lengths of the side edges. In particular, side edge 140 includes a curve 150, and side edge 142 includes a curve 152. Curves 150 and 152 are complementary in shape, in that curve 150 is concave with respect to the platform and curve 152 is convex. The curves are also comparable in size such that a side edge identical to side edge 152 could be received or nest within curve 150 of side edge 150. Such an arrangement is described in greater detail with respect to FIG. 3.

As shown in FIG. 2, concave curve 150 is located adjacent to the pressure side 130 of airfoil 122. Curve 150 is also positioned along an intermediate portion 151 of side edge 140, with the apex 154 of curve 150 being located axially between the respective intersections of the leading and trailing edges of the airfoil and the platform. Notably, apex 154 is defined as the point along the curve most distant from an imaginary line (depicted in dashed lines) connecting corresponding ends of the leading and trailing edges of the platform. Similarly, convex curve 152 is located at an intermediate portion 153 of suction side edge 142.

The curved side edges potentially reduce axial strain of the platform, particularly on the pressure side edge 140. Specifically, the reduction in material of the platform on the pressure side accommodates axial thermal growth, which tends to be restricted by the intersections of the airfoil and the platform. Additionally, the reduction in material of the platform due to the curves reduces the mass moment arm of the platform, thereby tending to reduce creep.

Figure 3:
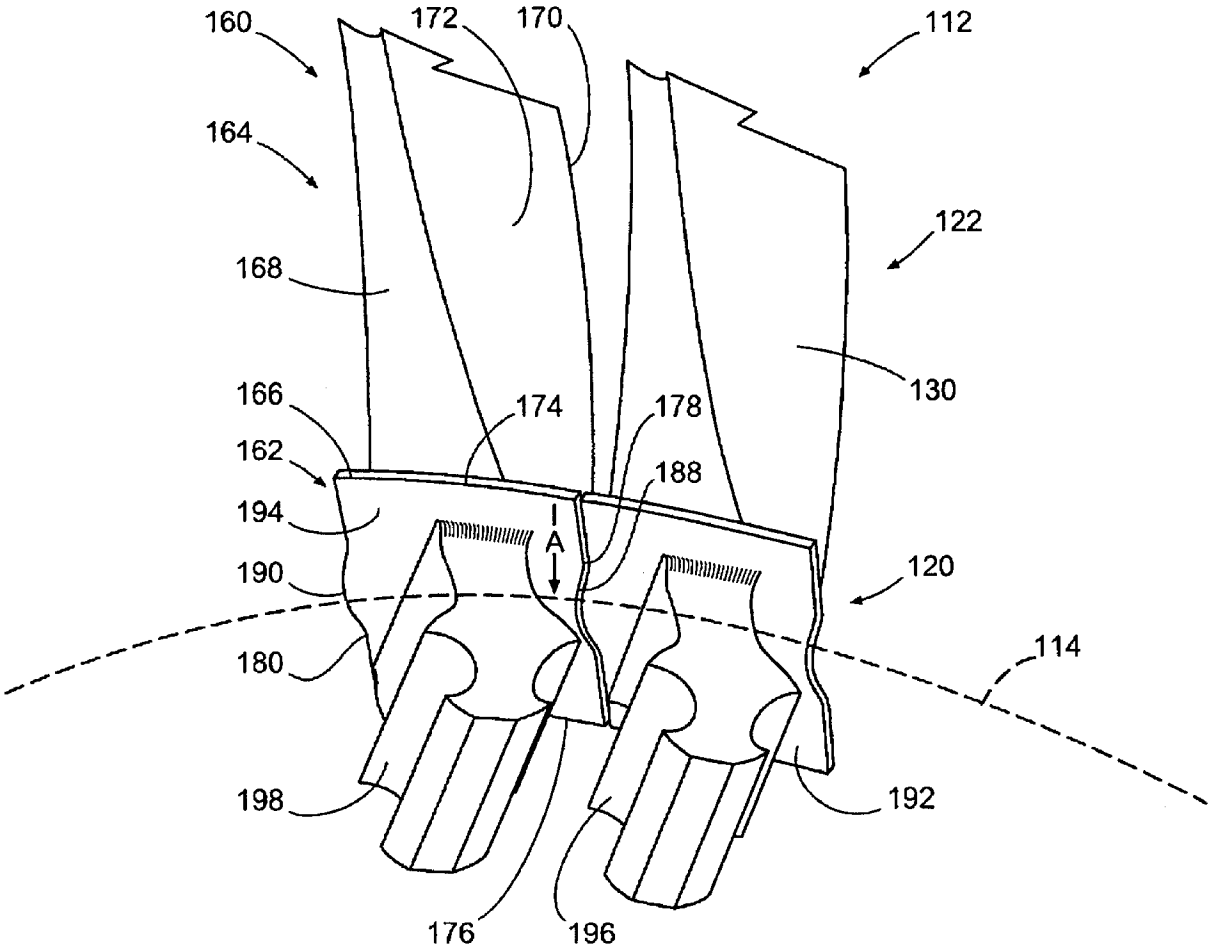
FIG. 3 is a schematic diagram depicting an exemplary embodiment of an assembly for a gas turbine engine.

FIG. 3 is a schematic diagram depicting an exemplary embodiment of an assembly for a gas turbine engine that includes blade 112 and an adjacent blade 160. As shown in FIG. 3, blade 160 incorporates a platform 162 and an airfoil 164 that extends from a gas path side 166 of platform 162. Airfoil 164 includes a leading edge 168, a trailing edge 170, a pressure side 172 and a suction side (not shown). Similarly, platform 162 includes a leading edge 174, a trailing edge 176, a pressure side edge 178 and a suction side edge 180.

Similar to blade 112, side edges 178 and 180 exhibit curves that extend along portions of the lengths of the side edges. In particular, side edge 178 includes a concave curve 188, and side edge 180 includes a convex curve 190. Notably, side edge 142 and curve 152 of blade 112 engage side edge 178 and curve 188 of blade 160.

FIG. 3 also depicts the non-gas path sides 192 and 194 of the blades. In this regard, a blade neck 196 extends from side 192, and a blade neck 198 extends from side 194. The blade necks are used to attach the blades to an associated turbine disk, in this case, turbine disk 114 (depicted in dashed lines).

In this embodiment, each of the blades is formed as a unitary structure, with a continuous exterior surface of each of the blades blending from the airfoil to the platform, and from the platform to the blade neck. For instance, in some embodiments, each of the blades can be formed of a single crystal material. Notably, various techniques can be used to form an assembly. By way of example, in some embodiments, casting techniques can be used, whereas, in some embodiments, grinding techniques, such as Super Abrasive Machining (SAM) can be used, particularly for forming curved surfaces.

In operation, cooling air (depicted by arrow A) is directed between the non-gas path sides 192, 194 of the blades and the turbine disk 114. This tends to extract heat from the blade necks. Notably, since the material of the blades exhibits relatively few thermal discontinuities, extracting heat from the blade necks enables conductive cooling of the platforms. In some embodiments, the degree of cooling provided in this manner can alleviate the need for additional cooling provisioning of the platforms.

It should be emphasized that the above-described embodiments are merely possible examples of implementations set forth for a clear understanding of the principles of this disclosure. Many variations and modifications may be made to the above-described embodiments without departing substantially from the spirit and principles of the disclosure. By way of example, although curved edges have been described with respect to inner diameter platforms, curved edges can additionally or alternatively be exhibited by outer diameter platforms. All such modifications and variations are intended to be included herein within the scope of this disclosure and protected by the accompanying claims.

The invention claimed is:

1. An airfoil assembly for a gas turbine engine comprising:

a platform having a gas path side, a non-gas path side, a leading edge, a trailing edge, a first side edge extending between the leading edge and the trailing edge and exhibiting a first curve along a length thereof, and a second side edge extending between the leading edge and the trailing edge and exhibiting a second curve along a length thereof; and an airfoil extending from the gas path side of the platform;

the platform and the airfoil exhibiting a unitary construction such that a continuous exterior surface blends from the airfoil to the platform.

2. The assembly of claim 1, wherein the first curve of the first side edge of the platform is concave and the second curve of the second side edge of the platform is convex.

3. The assembly of claim 2, wherein:

the airfoil has a pressure side and a suction side;

the first side edge of the platform is located adjacent to the pressure side; and the second side edge of the platform is located adjacent to the suction side.

4. The assembly of claim 3, wherein an apex of the first curve is located axially between an intersection of the leading edge of the airfoil and the gas path side of the platform and an intersection of the trailing edge of the airfoil and the gas path side of the platform.

5. The assembly of claim 1, wherein the airfoil and the platform are formed by a single crystal of material.

6. The assembly of claim 1, wherein the airfoil is a blade airfoil and the platform is a blade platform.

7. The assembly of claim 6, further comprising a blade neck extending from the non-gas path side of the platform, the blade neck being operative to attach the assembly to an associated disk.

8. The assembly of claim 6, wherein the blade airfoil is a turbine blade airfoil and the blade platform is a turbine blade platform.

9. The assembly of claim 1, wherein the platform is an inner diameter platform.

10. An assembly for a gas turbine engine comprising:

a first airfoil assembly having a first platform and a first airfoil; and a second airfoil assembly having a second platform and a second airfoil a first platform having a gas path side, a non-gas path side, a leading edge, a trailing edge, and a first side edge extending between the leading edge and the trailing edge and exhibiting a first curve along a length thereof;

the first airfoil extending from the gas path side of the first platform;

the first platform and the first airfoil exhibiting a unitary construction such that a continuous exterior surface blends from the first airfoil to the first platform;

the second platform having a gas path side, a non-gas path side, a leading edge, a trailing edge, and a second side edge extending between the leading edge and the trailing edge and exhibiting a second curve along a length thereof;

the second airfoil extending from the gas path side of the second platform;

the second platform and the second airfoil exhibiting a unitary construction such that a continuous exterior surface blends from the second airfoil to the second platform;

the first side edge being complementary in shape with respect to the second side edge.

11. The assembly of claim 10, wherein an apex of the first curve is located axially between an intersection of the leading edge of the first airfoil and the gas path side of the first platform and an intersection of the trailing edge of the first airfoil and the gas path side of the first platform.

12. The assembly of claim 10, wherein the first curve of the first side edge of the first platform is concave and the second curve of the second side edge of the second platform is convex.

13. The assembly of claim 10, wherein the first airfoil and the first platform are formed by a single crystal.

14. The assembly of claim 10, wherein the first airfoil is a blade airfoil and the first platform is a blade platform.

15. The assembly of claim 10, wherein the platform is an inner diameter platform.

16. A gas turbine engine comprising:

a compressor; and a turbine operative to drive the compressor;

at least one of the compressor and the turbine having a platform and an airfoil, the platform having a gas path side, a non-gas path side, a leading edge, a trailing edge, a first side edge extending between the leading edge and the trailing edge and exhibiting a first curve along a length thereof, and a second side edge extending between the leading edge and the trailing edge and exhibiting a second curve along a length thereof, the airfoil extending from the gas path side of the platform;

the platform and the airfoil exhibiting a unitary construction such that a continuous exterior surface blends from the airfoil to the platform.

17. The engine of claim 16, wherein:

the platform is a blade platform;

the turbine has a turbine disk; and the engine further comprises a blade neck extending from the non-gas path side of the platform, the blade neck being operative to attach to the turbine disk such that the blade neck, platform and airfoil rotate with the turbine disk.

18. The engine of claim 17, wherein the engine is operative to direct cooling air between the non-gas path side of the platform and the turbine disk such that cooling of the platform is provided, at least in part, by conductive cooling attributable to the blade neck.

19. The engine of claim 18, wherein the turbine is a low pressure turbine.

20. The engine of claim 17, wherein the engine is a turbofan gas turbine engine.

21. The blade of claim 11, wherein the platform is an inner diameter platform.

* * * * *